US005214939A

United States Patent [19]

Drucker et al.

[11] Patent Number: 5,214,939

[45] Date of Patent: Jun. 1, 1993

[54] VARIABLE AREA REFRIGERANT EXPANSION DEVICE HAVING A FLEXIBLE ORIFICE

[75] Inventors: Alan S. Drucker, DeWitt; Alan D. Abbott, Manlius, both of N.Y.

[73] Assignee: Carrier Corporation, Syracuse, N.Y.

[21] Appl. No.: 797,583

[22] Filed: Nov. 25, 1991

[51] Int. Cl.[5] ..... F25B 41/06; F25B 13/00

[52] U.S. Cl. ..... 62/527; 62/324.6; 62/511

[58] Field of Search ..... 62/324.1, 324.6, 504, 62/511, 527, 528

[56] References Cited

U.S. PATENT DOCUMENTS

| | | | |
|---|---|---|---|
| 4,263,787 | 4/1981 | Domingorena | 62/324.6 |
| 4,324,112 | 4/1982 | Fujiwara et al. | 62/511 |
| 4,412,432 | 11/1983 | Brendel | 62/527 X |
| 4,448,211 | 5/1984 | Yoshida | 62/324.6 X |
| 4,653,291 | 3/1987 | Moeller et al. | 62/527 X |
| 5,031,416 | 7/1991 | Drucker et al. | 62/527 X |
| 5,085,058 | 2/1992 | Aaron et al. | 62/511 X |
| 5,097,866 | 3/1992 | Shapiro-Baruch et al. | 62/511 X |

FOREIGN PATENT DOCUMENTS

| | | | |
|---|---|---|---|
| 1451493 | 1/1989 | U.S.S.R. | 62/511 |

*Primary Examiner*—Henry A. Bennet
*Assistant Examiner*—Christopher B. Kilner

[57] ABSTRACT

A refrigeration expansion valve meters the flow of refrigerant therethrough through a flexible orifice that varies in cross sectional area as a function of the pressure differential across the valve. The flexible orifice is provided in a tubular elastomeric element that is supported at opposite ends by rigid support means. A rigid spacer means is provided for engaging the support means to prevent the pressure differential of the refrigeration system from exerting an axial force on the flexible flow metering element.

4 Claims, 2 Drawing Sheets

VARIABLE AREA REFRIGERANT EXPANSION DEVICE HAVING A FLEXIBLE ORIFICE

BACKGROUND OF THE INVENTION

1. Field of the Invention

This invention relates in general to refrigerant expansion devices. More specifically, it relates to expansion devices that have a variable expansion area that is operated by the pressure differential existing between the high pressure and the low pressure side of a refrigeration system.

2. Description of the Prior Art

A compression refrigeration system comprises: a compressor, a condenser, an expansion device and an evaporator connected in a closed circuit to provide refrigeration. Hot compressed refrigerant vapor from the compressor enters the condenser, where it transfers heat to an external heat exchange medium and condenses. Liquid refrigerant, at a high pressure flows from the condenser to the expansion device, where the refrigerant under goes a pressure drop and at least partially flashes to a vapor. The liquid vapor mixture then flows through the evaporator where it evaporates and absorbs heat from the external surroundings. The low pressure refrigerant vapor then returns to the compressor to complete the circuit.

Although the expansion device is often a simple construction, its role in the refrigeration system is crucial. Ideally, the expansion device should meter refrigerant in a manner such that refrigerant leaving the evaporator is super-heated by a controlled, relatively small amount. The foregoing is desired to prevent any damaging liquid or refrigerant from entering the compressor and to avoid subjecting the compressor to excessive temperature s from highly supper-heated vapor. The performance of the expansion device plays an important role not only in protecting the compressor, but also in determining the cooling capacity of the refrigeration system. Since the system is a closed circuit, any effect the device has on the low or evaporator side is intimately tied in with the performance of the high or condenser side. Most conventional air conditioning systems incorporating compression refrigeration units of the kind described are designed to have a predetermined cooling capacity at a given ambient temperature. The capacity of the system usually decreases at ambient temperatures above the design point. The decrease in capacity of the system at temperatures above the design point is directly related to the type and design of the expansion device.

Among the most commonly used expansion devices are thermostatic expansion valves, capillary tubes and other fixed orifice devices. Thermostatic expansion valves control the flow rate of liquid refrigerant entering the evaporator as a function of the temperature and pressure of the refrigerant gas leaving the evaporator. This control is achieved by varying the cross-sectional area through a needle type valve contained within the valve body. The needle is typically joined to a flexible metal bellows or diaphragm which is, in turn, actuated by a non-heat conducting rod connected at its other end to a sealed bellows. The sealed bellows, in turn, is joined to a thermostatic sensing bulb by means of a capillary tube. This bulb provides feedback to the valve relating to the temperature of the refrigerant leaving the evaporator and the valve responds by increasing or decreasing the flow of refrigerant through the needle valve according to this feedback. While being highly efficient in their operation and readily responsive to changes in load upon system to vary the flow of refrigerant to the evaporator, thermostatic expansion valves are also complicated and relatively expensive. Further, in split system type air conditioning systems, wherein the compressor and condenser are located outside at a remote location from the evaporator, the distance of the sensing bulb from the compressor results in less than optimum conditions in such systems.

Capillary tubes are quite often used in place of thermostatic expansion valves, particularly in smaller applications, wherein ambient air is almost universally utilized as the condensing medium. Although capillary tubes are relatively inexpensive to manufacture and are simple to install, they have some serious operating limitations, particularly when they are operating at conditions above or below the design point of the system.

As an example, as the outdoor ambient temperature increases there is an increase in the pressure differential across the expansion device and the compressor. At higher pressure ratios the compressor pump a lower flow rate, however, a capillary type expansion device at such higher pressure ratio passes a higher flow rate. This flow imbalance results in the loss of stored subcooled liquid refrigerant from the high side and loss of superheat and flooding of the low side. These phenomenon greatly reduce system efficiency and performance.

An additional problem is found at relatively low ambient temperatures, wherein the pressure differential across the expansion device is of a relatively small magnitude. Under these conditions the subcooling of the refrigerant entering the expansion device increases as the outdoor ambient temperature falls, leading to more refrigerant being stored in the condenser, which starves the evaporator. As a result, more of the evaporator becomes filled with superheated vapor and the superheat leaving the evaporator increases. Using increased evaporator surface to superheat refrigerant is not putting the surface to its most effective use.

Another known fixed orifice expansion device is the orifice plate. Very simply, an orifice plate comprises a thin plate having an expansion orifice extending therethrough. Orifice plates are small and inexpensive, but they are erratic in performance. Hence, such plates are not in wide use.

In an attempt to provide an alternate expansion device, having the economical advantages of the capillary tube, while being smaller and more efficient in operation, the expansion device described in commonly assigned U.S. Pat. No. 3,642,030 entitled "Refrigerant Throttling Device" and issued on Feb. 15, 1972 in the name of Larry D. Amick was developed. That device comprises a body member having a tubular insert having prescribed length-to-bore diameter ratios, a conical inlet, and a conical exit.

Continuing efforts to develop an economical, efficient and effective fixed orifice expansion device resulted in the development of the expansion device described in commonly assigned U.S. Pat. No. 3,877,248 entitled "Refrigerant Expansion Device" which issued Mar. 1, 1974 in the name of Fred V. Honnold, Jr. That device comprises a body having an expansion conduit extending therethrough with a flat entrance presenting a sharp edge orifice to incoming refrigerant. The sharp edge entrance orifice effects a major portion of the refrigerant pressure drop at the entrance, so that only a short conduit length is necessary to effect the balance of the pressure drop demanded of the device. The body member is incorporated in a unitary coupling member configured to join refrigerant lines from the condenser to the evaporator.

Commonly assigned U.S. Pat. No. 3,992,898 entitled "Moveable Expansion Valve" which issued Nov. 23, 1976, in the name of Richard J. Duell and John A. Ferrel represents a further refinement of a fixed orifice expansion device. In the device of this patent, the refrigerant metering port is formed in a free floating piston which is mounted within a chamber. When refrigerant flows through this device in once direction, the free floating piston moves to one position wherein the refrigerant flow is through the metering port thereby serving as an expansion device. When refrigerant flows through this device in the opposite direction, the free floating piston moves to a second position, wherein refrigerant is allowed to flow through a number of flow channels formed in the outer peripheral surface of the piston to thereby allow substantially unrestricted flow through the device. This arrangement allows such a device to be used, in combination with a second expansion device of the same design in a heat pump system to allow the desired expansion of the refrigerant through the system flowing in both the cooling and heating directions.

In a cooling only system the expansion device of the U.S. Pat. No. 3,992,898 allows a system to be adjusted as to the amount of refrigerant superheat and other expansion parameters by changing the piston contained within the valve body in the field. The piston usually is changed to match the diameter of the metering port, running the length of the piston, with the requirements of a particular system to optimize performance.

U.S. Pat. No. 4,263,787, issued to the assignee hereof, entitled "Expansion Device with Adjustable Refrigerant Throttling" which issued Apr. 28, 1981 to Albert A. Domingorena relates to an improvement of the device of the U.S. Pat. No. 3,992,898 which allows adjusting the diameter of the metering port without having to break into the refrigeration circuit of the system to change the piston.

Summing up the state of the prior art, thermostatic expansion valves, while being highly efficient in their operation and readily responsive to changes in load upon the system to vary the flow of refrigerant to the evaporator, are complicated, expensive, and have drawbacks in certain applications. For this reason they are generally not employed in small applications. As a result, capillary tubes or other fixed orifice expansion devices are generally used in small applications. Such devices are relatively inexpensive, however, as discussed above, they have operating limitations at both high and low ambient temperatures.

From the foregoing, it is evident that the need exists for a refrigerant expansion device which is inexpensive to manufacture and which is effective in performance over a wide range of operating conditions.

Commonly assigned U.S. Pat. No. 5,031,416 entitled "Variable Area Refrigerant Expansion Device Having a Flexible Orifice" which issued Jul. 16, 1991 in the name of Alan S. Drucker and Peter L. Cann discloses such a device. In the '416 patent a refrigerant expansion device is provided wherein the flow metering port is formed an elastomeric element and the elastomeric element deforms in response to an increased pressure differential across the device to decrease the size of the flow metering port. It has been found that in operation, at high pressure differentials, the size of the refrigerant expansion orifice according to the '416 design will change in size as a result of a net axial force on the expansion element which is proportional to the difference between the high pressure and the low pressure side of the refrigeration system.

SUMMARY OF THE INVENTION

An object of the present invention is to meter the flow of refrigerant in a refrigeration system in response to the operating conditions of the system.

Another object of the present invention is to control the cross sectional area of the flow metering passage of an expansion device as a function of the pressure differential between the high pressure side and low pressure side of the refrigeration system.

It is yet a further object of the present invention to meter the flow of refrigerant through a refrigerant expansion device in one direction through an orifice which varies in size as a function of a pressure differential between the high and low pressure sides of the refrigeration system, and, allow an unrestricted flow of refrigerant through the same device in the opposite direction.

It is a further object of the present invention to provide a refrigerant expansion device wherein the flow metering port is formed in an elastomeric element and the elastomeric element deforms in response to an increased pressure differential across the expansion device to decrease the size of the flow metering port.

Still another object of the present invention is to provide such an expansion device wherein the size of the flow metering port is not effected by the net axial force imposed upon the deformable expansion element caused by the difference in the high and low pressure sides of a refrigeration system.

These and other objects of the present invention are achieved by a refrigerant expansion device for metering the flow of refrigerant between the high and low pressure sides of a refrigeration system. The expansion device includes a housing having a flow passage extending therethrough which is defined in part by an inner wall of the housing. The flow metering element is mounted within the flow passage. The flow metering element has an outer wall and a flow metering port having an inner wall extending longitudinally therethrough. The flow metering element is made from an elastomeric material. Means are provided for co-axially supporting the flow metering element within the flow passage so that the inner wall of the housing and outer wall of the metering element cooperate to define a chamber therebetween. Means are provided for maintaining the pressure within the chamber at the pressure of the high pressure side of the refrigeration system. Means are also provided for preventing the flow of refrigerant through the chamber. As a result the pressure within the chamber surrounding the flow metering element is the same as the high pressure side of the refrigeration system, and, the interior of the flow metering element is at the low side pressure of the system. As a result the pressure differential causes a decrease in the size of the flow metering port as the pressure differential between the high and low sides of the system increases. Means are provided for preventing the pressure differential between the high pressure side and the low pressure side of the refrigeration system from exerting an axial force on the elastomeric flow metering element.

BRIEF DESCRIPTION OF THE DRAWINGS

The novel features that are considered characteristic of the invention are set forth with particularity in the appended claims. The invention itself, however, both as to its organization and its method of operation, together with the additional objects and advantages thereof, will best be understood from the following description of the preferred embodiment when read in connection with the accompanying drawings wherein like numbers have been employed in the different figures to denote the same parts, and wherein;

DESCRIPTION OF PREFERRED EMBODIMENT

Figure 1:
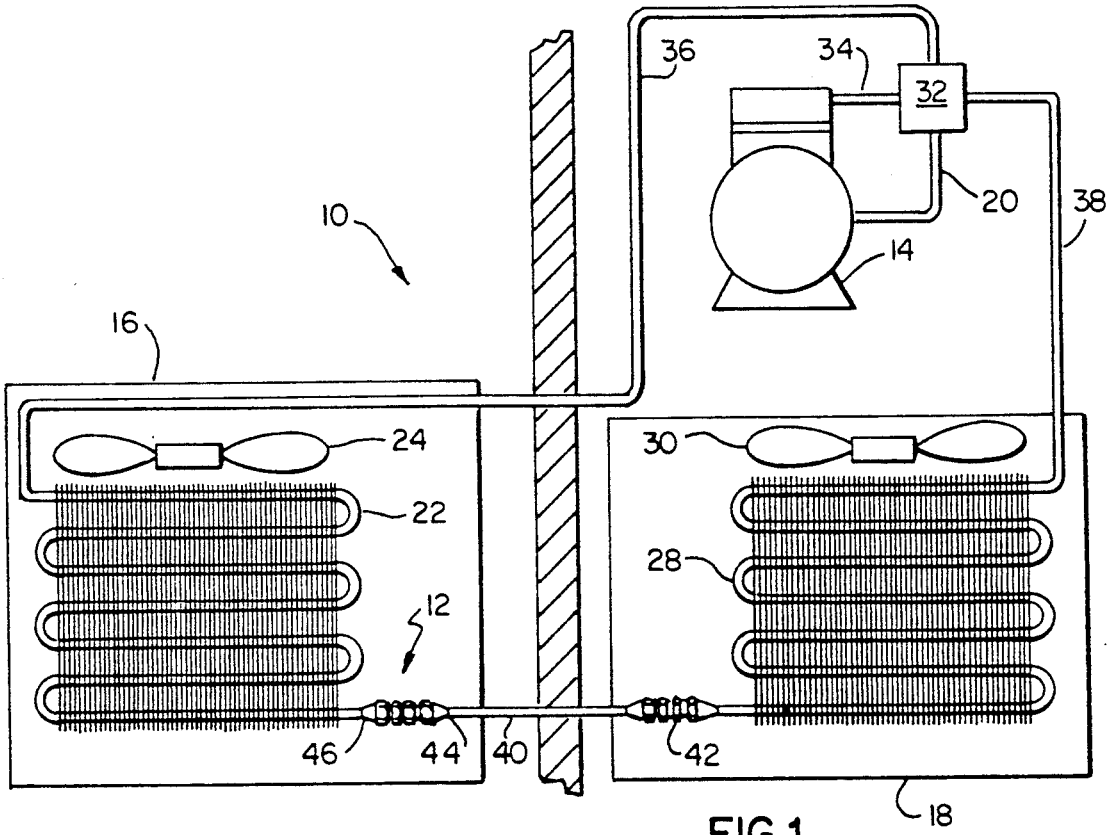
FIG. 1 is a schematic representation of a typical refrigeration system of the type capable of being thermodynamically reversed to provide either heating or cooling, and, making use of the expansion device of the present invention as a cooling expansion valve.

With reference first to FIG. 1, numeral 10 designates a heat pump system of substantially conventional design, but having a variable area expansion valve 12 according to the present invention. The heat pump 10 also includes a compressor 14, an indoor heat exchanger assembly 16 and an outdoor heat exchanger assembly 18. The indoor heat exchanger 16 includes a refrigerant-to-air heat exchange coil 22 and an indoor fan 24. The outdoor heat exchanger assembly 18 includes a refrigerant-to-air heat exchange coil 28 and an outdoor fan 30. The indoor and outdoor heat exchanger assemblies are of conventional design and will not be described further.

A 4-way reversing valve 32 is connected to the compressor discharge port by a refrigerant line 34, to the compressor suction port by refrigerant suction line 20 and to coils 22 and 28 by refrigerant lines 36 and 38, respectively. The reversing valve 32 is also a conventional design for directing high pressure refrigerant vapor from the compressor to either the indoor coil 22, in the heating mode of operation or, during the cooling mode and defrost mode, to the outdoor coil 28. Regardless of the mode of operation, the reversing valve 32 serves to return refrigerant from the coil which is operating as an evaporator to the compressor via suction line 20.

A refrigerant line 40 interconnects the indoor heat exchanger coil 22 and the outdoor heat exchanger coil 28. The variable area expansion valve 12, according to the present invention, is located in the line 40, within the indoor heat exchanger assembly housing 16, adjacent to the indoor coil 22. An expansion valve 42 dedicated to the heating mode of operation is located at the other end of the refrigerant line 40, within the outdoor heat exchange assembly housing 18, adjacent to the outdoor coil 28. The heating expansion valve 42 is of the type that meters the flow of refrigerant therethrough when it is flowing through the valve towards the outdoor coil 28 and freely bypasses the flow of refrigerant when it is flowing from the outdoor coil 28 in the direction of the indoor coil 22. The heating expansion valve 42 could be of the type described in the above discussed U.S. Pat. No. 3,992,898 and will not be further described herein. The structure of the variable area expansion valve 12 will now be described in detail followed by a description of the valve in its cooling and bypass modes of operation.

Turning now to FIGS. 2-9, the expansion device 12 comprises a generally cylindrical housing 44 having a male thread formed at each end thereof which is adapted to mate with female connectors 46, 44 (FIG. 1) associated with the refrigerant line 40 to create a fluid tight joint therebetween. A flow passage 50, which is axially aligned with the housing body, passes into the body from the left hand side of the expansion device as viewed in FIGS. 2, 4 and 7. The diameter of the flow passage is substantially equal to or greater than the internal opening of the supply line 40 and thus is capable of supporting the flow passing therethrough without restriction. The flow passage 50 opens into an expanded chamber 52 bored, or otherwise machined into the opposite end of the housing body. The transition from the flow passage 50 to the expanded chamber 52 defines a right hand facing shoulder or end wall 53.

The open right hand end of the chamber 52 is provided with a nipple 54 which is press-fitted therein and which contains a tapered internal opening 56, narrowing down to the diameter of the internal opening of the supply line 40. An 0 ring 58 is carried within an annular groove 60 formed about the outer periphery of the nipple, which serves to establish a fluid-tight seal between the internal wall of the chamber 52 and the nipple 54.

A freely moving flow metering piston assembly 62 is slidably mounted within the expanded chamber 52. The flow metering piston assembly 62 includes a longitudinally extending flow metering element 64 having a flow metering port 66 extending longitudinally therethrough. The flow metering element 64 is supported within the chamber 52 by a pair of support and guide discs 68, 69 which are attached to the flow metering element at the left and right ends thereof, respectively. Each of the discs 68, 69 includes a circular planar portion 70 having a centrally located opening 72 therethrough for receiving and supporting one of the ends 74 of the flow metering element 64.

The diameter of the planar circular portion 70 of the guide discs is substantially less than the inside diameter of the chamber 52. Extending from the outer periphery of the circular portions 70 are a plurality of L shaped legs each having a first section 78, substantially coplanar with the circular portion 70, and, a second section 80 substantially perpendicular thereto. The guide discs 68, 69 are oriented so that sections 80, of the plurality of L shaped legs face one another. As a result the ends of the discs 68, 69 facing axially outwardly each define a flat parallel end face 82 and 84 at the left and right hand ends thereof, respectively. The flow metering piston assembly 62 is of a length less than the length of the chamber 52 and is supported in the chamber by the disc 68,69 such that it is free to slide axially within the chamber. The left hand facing end face 82, of the disc 68, is adapted to engage in a fluid tight relationship, the right hand facing end wall 53 of the chamber 52. Similarly, the right hand end face 84, of the disc 69, is adapted to engage, and be stopped by, the left hand end of the tapered opening 56 of the nipple 54 when the piston is in its extreme right hand position within the chamber 52.

Figure 5:
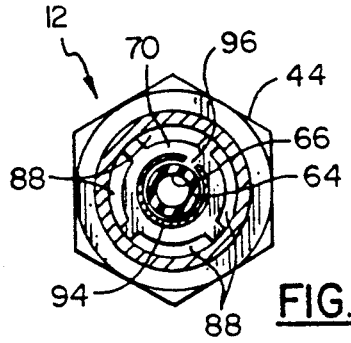
FIG. 5 is a sectional view of the expansion device taken along the lines 5—5 of FIG. 2.
Figure 3:
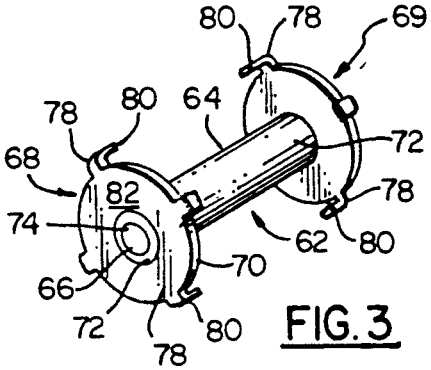
FIG. 3 is an enlarged perspective showing the flow metering piston assembly of the expansion device of FIG. 2.

When the flow metering pistion assembly 62 is mounted within the chamber 52 the inner wall 90 of the chamber and the outer wall of the flow metering element 64 cooperate to define an annular cavity 92. Also, as best seen in FIG. 5 when the flow metering piston assembly 62 is mounted within the chamber 52 a plurality of arcuately shaped flow openings 88 are defined between each of the support discs 68, 69 and the inner wall 90 of the chamber 52.

In the preferred embodiment the flow metering element 64 of the flow metering piston assembly is made from a thermosetting material. The thermosetting material is preferably formed in a mold which allows it to be cast directly into the openings 72 in the support discs 68,69 to thereby assure a fluid tight seal therebetween. The material is elastomeric in nature and is preferably a synthetic rubber which will remain dimensionally stable in a refrigerant environment. A metal sleeve 94 surrounds the flow metering element 64 and extends between the inner faces of the support and guide discs 68 and 69. The sleeve has a longitudinal slit 96 extending its full length in order to facilitate installation. As will be appreciated as the operation of the device is described the sleeve serves as a spacer to prevent imposition of an axial face on the flow metering element 64. The sleeve is preferably made from copper.

In operation, the variable area expansion valve 12, is installed in the refrigerant liquid line 40 in a system as shown in FIG. 1 to meter refrigerant as it moves, at high pressure, from heat exchanger 28 serving as a condenser coil to heat exchanger 22, at low pressure, serving as an evaporator. Under the influence of the flowing refrigerant, the piston assembly 62 is moved to the left to the position illustrated in FIG. 2. With the piston assembly 62 in this position the left hand end face 82 of the disc 68 is in fluid tight engagement with the right hand facing end wall 53 of the chamber 52. As a result of this engagement the arcuate flow openings 88 are sealed against fluid flow therethrough and the only path for refrigerant flow through the expansion device is through the flow metering port 66 to thereby throttle the refrigerant from the high pressure side of the system to the low pressure side.

Figure 2:
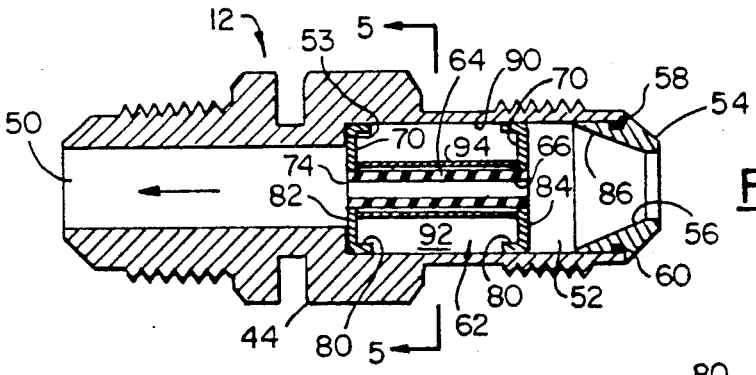
FIG. 2 is a longitudinal sectional view through an expansion device according to the present invention.
Figure 4:
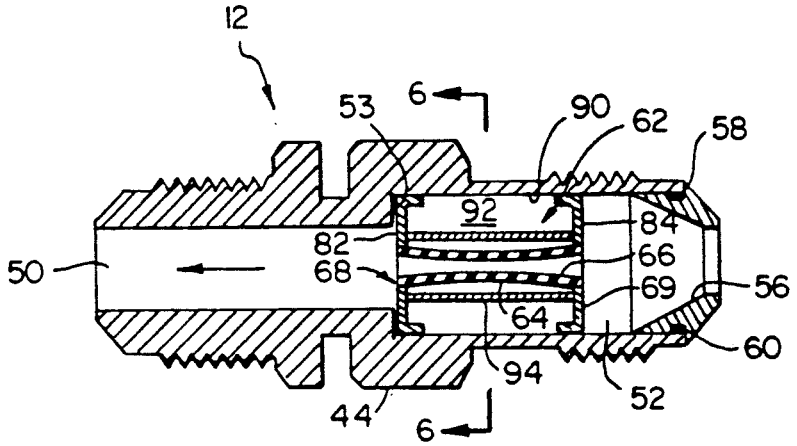
FIG. 4 is a longitudinal sectional view of the expansion device of FIG. 2 showing operation of the device while in the cooling mode of operation.

FIG. 2 illustrates the valve 12 in a condition representing a relatively low pressure differential between the high and low pressure side of the system. As shown, the high pressure portion of the refrigeration system extends into the valve, through the nipple 54, past the right hand support disc 69 and into the annular cavity 92 defined between the enlarged chamber 52 and the outer wall of the flow metering element 64. It should be appreciated then, that as shown in FIGS. 2 and 4, the outside of the flow metering element 64 (i.e. the annular cavity 92) is subjected to the high pressure side of the refrigeration system while the interior of the flow metering element (i.e. the flow port itself 66) is essentially at the pressure of the low pressure side of the refrigeration system.

As a result of this arrangement, as the pressure differential of the system increases the pressure within the annular cavity 92 surrounding the flow metering element 64 increases. As a result, because of the elastomeric properties of this element, the entire element is compressed inwardly to thereby reduce the cross sectional area of the flow metering port 66 extending therethrough. FIG. 4 represents the variable area expansion valve 12 in operation at a relatively high system pressure differential. Comparison of FIGS. 4 and 6 (high pressure differential) to FIGS. 2 and 5 (low pressure differential) makes clear the substantially reduced metering area through the valve during high pressure differential operation.

Figure 8:
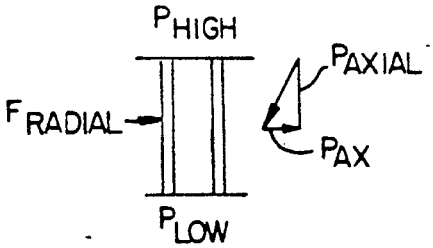
FIG. 8 is a simplified view of the flow metering element showing the forces exerted thereupon by the refrigerant fluid flowing through the expansion device.
Figure 7:
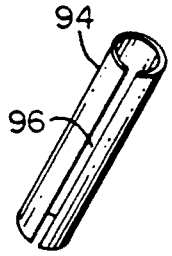
FIG. 7 is an enlarged perspective showing of the spacer element of the expansion device of FIG. 2.
Figure 6:
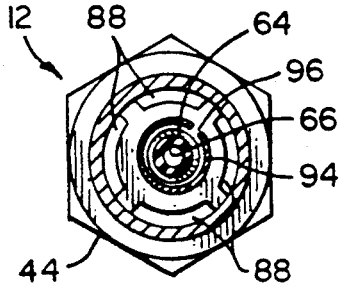
FIG. 6 is a sectional view of the expansion device taken along the lines 6—6 of FIG. 4.

Looking now at FIG. 8 the flow metering piston assembly 62 is shown without the spacer sleeve 94 installed. The forces acting upon the assembly due to the pressure differential across the piston are shown by the use of arrows. As noted, the high pressure is the upper end and the lower pressure side the lower end. The difference between the high pressure and the low pressure which is relied upon to cause changes in the cross sectional area of the orifice is represented by the arrow labeled F radial.

There is however an additional force on the expansion device that must be accounted for. Since the axial ends of the device are subject to different pressures, there is also a net axial force exerted on the tube. This axial force, which is the difference between the pressure entering and leaving the expansion device, also keeps the piston seated properly when the device is serving to expand refrigerant therethrough. Since the tube walls are not linear, particularly at high pressure differentials, part of this axial force identified by the arrow Pax is exerted on the diameter of the piston. This additional force Pax is eliminated in the present device by placing spacer sleeve 94 in position thus assuring that any changes in the diameter of the expansion orifice are due to the F radial force and is not interferred with by the component of the axial force acting in the radial direction.

It should be appreciated that, the ability of the expansion valve 12 to respond to the pressure differential across the valve, to thereby provide a refrigerant metering cross sectional area which is proportional to the pressure differential across the valve, enables the valve to adapt to system operating conditions. The valve is thus able to meter refrigerant in a manner such that the refrigerant leaving the evaporator is superheated by a controlled, relatively small amount over a wide range of operating conditions.

Figure 9:
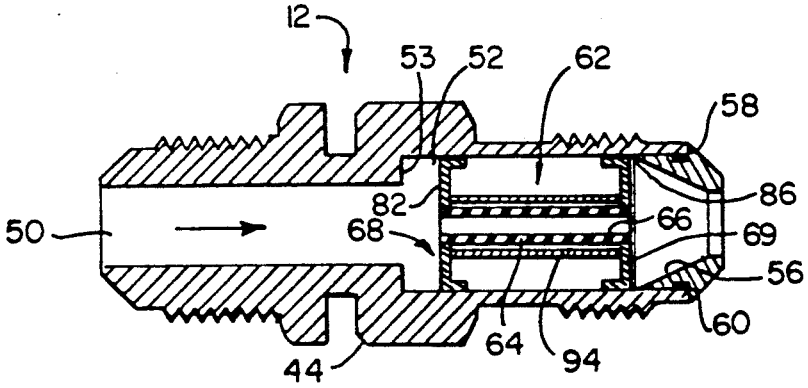
FIG. 9 is a longitudinal sectional view of the expansion device of FIG. 2 showing the device in the by-pass mode of operation.

Referring now to FIG. 9, when the refrigeration cycle is reversed and the refrigerant is caused to flow through the system in the opposite direction, the flow metering piston assembly 62 automatically moves to the position in FIG. 9, resting against the nipple 54. With the piston in this position the arcuate flow openings 88 in both guide discs 68, 69 are opened to the flow of refrigerant and thus provide an unrestricted flow path, around the flow metering port 66, through which refrigerant may freely pass to the down stream refrigerant line 40.

This invention may be practiced or embodied in still other ways without departing from the spirit or essential character thereof. The preferred embodiment described herein is therefor illustrative and not restrictive, this scope of the invention being indicated by the appended claims and all variations which come within the meaning of the claims are intended to be embraced therein.

What is claimed is:

1. A refrigerant expansion device for metering the flow of refrigerant between the high and low pressure sides of a refrigeration system comprising:

a housing having a flow passage extending therethrough, said flow passage being defined in part by an inner wall of said housing, said housing having a first stop means within said flow passage adjacent the end of said expansion device which is adapted to be connected to the low pressure side of the refrigeration system;

said housing having a second stop means within said flow passage, adjacent to the end of said expansion device adapted to be connected to the high pressure side of the refrigeration system;

said first stop means, and said second stop means, and, said inner wall of said housing together defining a chamber within said flow passage;

a flow metering piston assembly, slideably mounted within said chamber;

said piston assembly including;

a flow metering element, said flow metering element having an outer wall and a flow metering port extending longitudinally therethrough defined by an inner wall thereof, said flow metering element being formed from an elastomeric material;

first and second support means located at opposite ends of said flow metering element;

each of said support means sealingly engaging the outer wall of said flow metering element, and, having a centrally positioned opening therethrough in flow communication with said metering port, said first and second support means co-axially supporting said flow metering element within said chamber so that the inner wall of said chamber and said outer wall of said metering element cooperate to define an annular cavity therebetween, each of said first and second support means having axially extending flow openings formed in the outer periphery thereof capable of allowing the flow of refrigerant therethrough;

spacer means for engaging each of said first and second support means and for maintaining the axially spacing between said first and second support means at a fixed distance;

said flow metering piston assembly being arranged within said chamber to move to a first position within said chamber with said first support means in engagement with said first stop means when the refrigerant flow through the device is in the direction from the high pressure side to the low pressure side, said engagement of said first support means and said first stop means sealing said flow openings in said first support means to prevent the flow of refrigerant therethrough, and, when said flow metering piston assembly is in said first position throttling refrigerant through said flow metering port, and, wherein the high pressure side of the refrigeration system is in fluid communication with said annular cavity through said flow openings in the outer periphery of said second support means;

said flow metering piston assembly being moveable to a second position when the flow of refrigerant through said device is in the opposite direction, wherein said second support means is in engagement with said second stop means and wherein refrigerant flows freely through said flow openings in both said first and second support means.

2. The apparatus of claim 1 wherein said spacer means comprises a rigid member located within said annular cavity engaging both said first and second support means.

3. The apparatus of claim 2 wherein said rigid member comprises a length of hollow tubing surrounding said flow metering element said hollow tubing having means for allowing radial flow of refrigerant therethrough.

4. The apparatus claim 3 wherein said hollow tubing has a longitudinal opening extending the full length thereof.

* * * * *